US006709264B2

(12) United States Patent
Hermann et al.

(10) Patent No.: US 6,709,264 B2
(45) Date of Patent: Mar. 23, 2004

(54) CATALYTIC COMBUSTER

(75) Inventors: Ingo Hermann, Mainz (DE); Axel Junge, Mainz (DE); Martin Stadie, Langen (DE); Andre' Mack-Gardner, Aabergen (DE); Philip Klaus, Hochheim (DE)

(73) Assignee: General Motors Corporation, Detroit, MI (US)

( * ) Notice: Subject to any disclaimer, the term of this patent is extended or adjusted under 35 U.S.C. 154(b) by 19 days.

(21) Appl. No.: 09/996,237

(22) Filed: Nov. 20, 2001

(65) Prior Publication Data

US 2003/0096204 A1 May 22, 2003

(51) Int. Cl.[7] ..... F23D 14/16
(52) U.S. Cl. ..... 431/170; 431/7; 431/328
(58) Field of Search ..... 431/8, 10, 170, 431/354, 326, 328, 329, 7, 346

(56) References Cited

U.S. PATENT DOCUMENTS

| | | | | | |
|---|---|---|---|---|---|
| 713,421 | A | * | 11/1902 | Fouche | 431/346 |
| 2,087,031 | A | * | 7/1937 | Hays | 122/158 |
| 2,618,540 | A | * | 11/1952 | Teti | 48/180.1 |
| 2,911,035 | A | * | 11/1959 | Nieman et al. | 239/549 |
| 3,081,818 | A | * | 3/1963 | Braconier et al. | 48/180.1 |
| 3,677,714 | A | * | 7/1972 | Ledgett | 422/198 |
| 4,133,643 | A | * | 1/1979 | Choulat et al. | 422/182 |
| 4,230,443 | A | * | 10/1980 | Berg et al. | 431/328 |
| 5,447,427 | A | * | 9/1995 | Suzuki | 431/7 |
| 5,611,684 | A | * | 3/1997 | Spielman | 431/353 |
| 6,022,213 | A | * | 2/2000 | Harthun | 431/158 |
| 6,267,585 | B1 | * | 7/2001 | Suttrop | 431/354 |
| 2002/0142199 | A1 | * | 10/2002 | Goebel | 429/17 |

FOREIGN PATENT DOCUMENTS

| | | | |
|---|---|---|---|
| EP | 0 351 082 | * | 1/1990 |
| EP | 0 415 008 | * | 3/1991 |
| JP | 61-153404 | * | 7/1986 |
| JP | 62-155431 | * | 7/1987 |

OTHER PUBLICATIONS

USSN 09/820,600 filed Mar. 20, 2001, "Apparatus for Mixing Fuel and an Oxidant" Steven Goebel, Assignee: General Motors Corp.

* cited by examiner

*Primary Examiner*—Carl D. Price
(74) *Attorney, Agent, or Firm*—Cary W. Brooks

(57) ABSTRACT

A catalytic combuster having a mixing section upstream of a combustion section. The mixing section includes a multi-port injector for injecting a first reactant gas into the mixing section in a plurality of directions perpendicular the direction or flow of a second reactant gas.

24 Claims, 5 Drawing Sheets

CATALYTIC COMBUSTER

TECHNICAL FIELD

This invention relates to catalytic combusters for burning gases supplied thereto, and more particularly to a combuster having a unique mixing section for intimately mixing the gases before supplying them to the combustion catalyst.

BACKGROUND OF THE INVENTION

Catalytic combusters (a.k.a. catalytic burners) for burning gases are known and generally comprise a gas inlet section, a gas mixing section, and a catalyst, downstream of the mixing section, where combustion occurs. Combusters are used with a variety of gaseous, hydrogenous fuels, and have many applications one of which is to heat the fuel processor, or other components, of a fuel cell system. Fuel-cell-system combusters burn the tailgases (effluents) from the anode and cathode compartments of the fuel cell, which tailgases comprise hydrogen and oxygen respectively. So-called "radial inlet", prior art combusters have a mixing section like that shown in FIG. 1 which tend to (1) have a high pressure drop, and (2) produce a slow moving layer of well-mixed gases adjacent the perforated perimeter wail that defines the mixing chamber, (3) a more rapidly moving central region of poorly mixed gases, and (4) a relatively long residence time for the gases in the mixing section. Because of the long residence time in the mixing section, the heat that is generated in the combustion section, downstream of the mixing section, can be transmitted back into the mixing section where it can cause auto-ignition of the well-mixed gases (i.e. adjacent the perforated wall). This, in turn, can cause overheating or localized heating that can be detrimental to the combuster.

SUMMARY OF THE INVENTION

The present invention is an improved catalytic combuster that has a mixing section upstream of the combustion section that quickly and thoroughly mixes the gases before they enter the catalytic combustion section. The improved combuster has an easily maintainable design that is readily assembleable/disassembleable, has a relatively low pressure drop, and has a low residence time (and hence reduced auto-ignition potential) for the gases in the mixing section, yet still provides excellent mixing of the gases in the mixing section. More specifically, the invention is directed to an improvement to the mixing section of the combuster that achieves intimate mixing of the gases throughout the mixing section in a short distance from the inlet end of the combuster. The improved mixing section comprises a housing having a wall that defines the mixing chamber, a first gas-permeable, upstream distributor (e.g. open cell foam, sintered metal or a perforated plate) at the entrance to the mixing chamber for admitting one of the gases into the mixing chamber in a first direction, and a a second gas distributor in the form of a multi-port injector extending into the mixing chamber and surrounded by the housing wall for admitting the other gas into the mixing chamber in a plurality of directions generally perpendicular to the first direction According to one embodiment of the invention, the multi-port injector comprises a distribution ring having a first, inner, ported (i.e. perforated), annular wall that defines a hole in the center of the distribution ring, and a second, outer, ported annular wall spaced radially outboard from the first ported wall. The inner and outer walls together define an annular cavity that receives the second gas and is adapted to inject the second gas into the mixing chamber in a radially inwardly second direction through the first permeable wall, and a radially outwardly third direction through the second perforated wall. At least one conduit communicates the inlet with the distribution ring. Preferably, multiple such conduits extend between the inlet and the ring. Each of the conduits has a mouth that receives the other gas from the inlet. The several mouths are arranged in a circle concentric with the hole in the distribution ring, with the mouths opening through a baffle plate that separates the inlet from the vestibule. A conical deflector, concentric with, and radially inboard of, the circle of mouths, directs the second gas from the inlet into the conduits that supply the distribution ring.

According to another embodiment of the invention, the injector comprises a plurality of blind gas distribution tubes, each defined by a sidewall and extending into the mixing chamber downstream of the first gas distributor. The sidewalls each have a plurality of ports therein downstream of the first gas distributor for injecting the other gas into the mixing chamber in a direction generally perpendicular to the direction of flow of the first gas.

An inlet section of the combuster supplies the other gas to the injector. A gas-permeable, homogenizing diffuser (preferably an open-cell foam) at the downstream end of the mixing chamber restricts the outflow of the gases from the mixing chamber to promote mixing upstream of the diffuser and to distribute the outflow substantially uniformly over the cross section of the combuster transverse the length of the combuster at the entrance to the combustion section.

According to significant aspect of the invention, a plurality of openings are provided in the housing upstream of the distributor for supplying a first gas behind (i.e. upstream) the distributor. An annular plenum surrounds the openings (and preferably the downstream diffuser), and serves to supply the one gas to the openings in the housing behind the gas distributor. The gas flows in the plenum in a direction that is countercurrent to the direction of flow of other gas through the mixing section which helps to cool the mixing section and further suppress the possibility of auto-ignition. The combuster includes a vestibule located between the openings in the housing and the gas distributor to receive the one gas from the openings According to a preferred embodiment of the invention, the several sections (i.e. inlet, mixing and combustion) of the combuster are each separate and discrete units that are connected to the next adjacent unit by means of a quick-disconnect connection to provide convenient access to the innards of the combuster for readily maintaining the combuster or modifying it (e.g. during design development).

Combusters made in accordance with the distributor ring embodiment of the invetion have demonstrated 80+% mixing of the gases in 70% of the cross sectional area (i.e. transverse the direction of flow through the combuster) of the mixing section. In contrast only about 45% of the cross sectional area of the radial mixers (see FIG. 1) contained 80+% mixed gases. Such improved mixing is achieved in combusters in accordance with the present invention that have demonstrated as much as 34% lower pressure drop, and shorter residence times than the prior art radial inlet combusters.

BRIEF DESCRIPTION OF THE DRAWINGS

The invention will be better understood when considered in the light of the following detailed description of one specific embodiment thereof which is given hereafter in conjunction with the following drawings in which.

DESCRIPTION OF PREFERRED EMBODIMENTS

Figure 1:
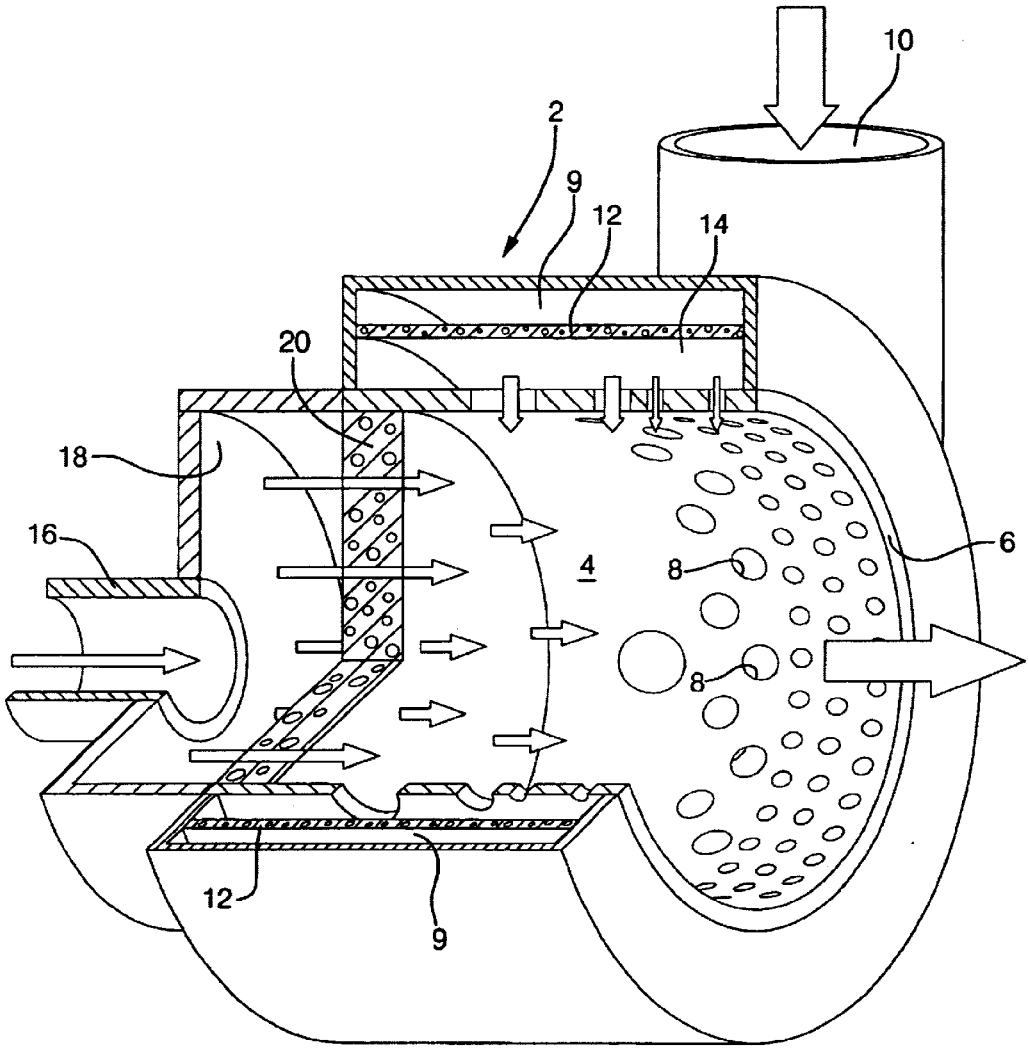
PRIOR ART FIG. 1
FIG. 1 is a sectioned isometrical view of a "radial inlet" mixing section of a prior art combuster.

FIG. 1 depicts the mixing section 2 of a prior art radial inlet combuster adapted to be connected, via a gas diffusing in foam (not shown) to a combustion section (not shown) downstream of the mixing section 2. The mixing section comprises a mixing chamber 4 defined by an annular, gas-distributing wall 6 having a plurality of apertures 8 varying in size (as shown) with the larger diameter apertures being upstream of the smaller diameter apertures. Gas (e.g. O2-containing cathode tailgas from an H2—O2 fuel cell) enters an annular plenum 9 via a tangential inlet 10, and passes through a porous sintered metal partition 12 that separates the plenum 9 from annular chamber 14 immediately behind the perforated wall 6. The porous sintered metal partition 12 creates a backpressure in the plenum 9 that causes the plenum 9 to pressurize equally throughout such that the gas therein will pass through the porous sintered metal partition 12 into the chamber 14 substantially uniformly over the entire area of the partition 12. Hence, the gas entering the chamber 14 will be distributed substantially uniformly throughout the chamber 14 from whence it passes into the mixing chamber 4 through the plurality of apertures 8 in the gas-distributing perforated wall 6.

A second gas (e.g $H_2$-containing. anode tailgas from an $H_2$—$O_2$ fuel cell) enters the mixing section 2 via the inlet 16 and fills the anode gas plenum 18. The anode gas plenum 18 is separated from the mixing chamber 4 by means of a porous sintered metal plate 20 which serves to provide backpressure in the anode gas plenum 18 and to distribute the flow of gas substantially uniformly across the cross section (i.e. transverse the direction of flow) of the mixing chamber 4. The first gas entering the mixing chamber 4 through the perforated cylindrical wall 6 mixes with the second gas entering the mixing chamber 4 through the porous sintered metal plate 20, and the mixed gases proceed from the mixing chamber 4 into the combustion section (not shown) of the combuster. Unfortunately, the gas does not mix uniformly throughout the cross section of mixing chamber 4. Rather, a high degree of mixing occurs in the region nearest the perforated wall 6. Significantly less mixing occurs in the radial center of the mixing chamber 4 remote from the perforated wall 6. When the poorly mixed gases reach the catalyst in the combustion section (not shown) an uneven temperature distribution occurs throughout the catalyst with hotter zones occurring near the center of the catalyst bed (i.e. where the gases are poorly mixed) than at the perimeter of the catalyst bed which receives the well mixed gases. Moreover, heat generated in the combustion section can propagate back into the mixing section and cause auto-ignition of the slow moving well-mixed gas adjacent the perforated wall 6. Auto-ignition in the mixing chamber 4 causes a sharp temperature rise therein which is detrimental to the materials that comprise the mixing section, and particularly, to the sintered materials 20 and 12.

Figure 2:
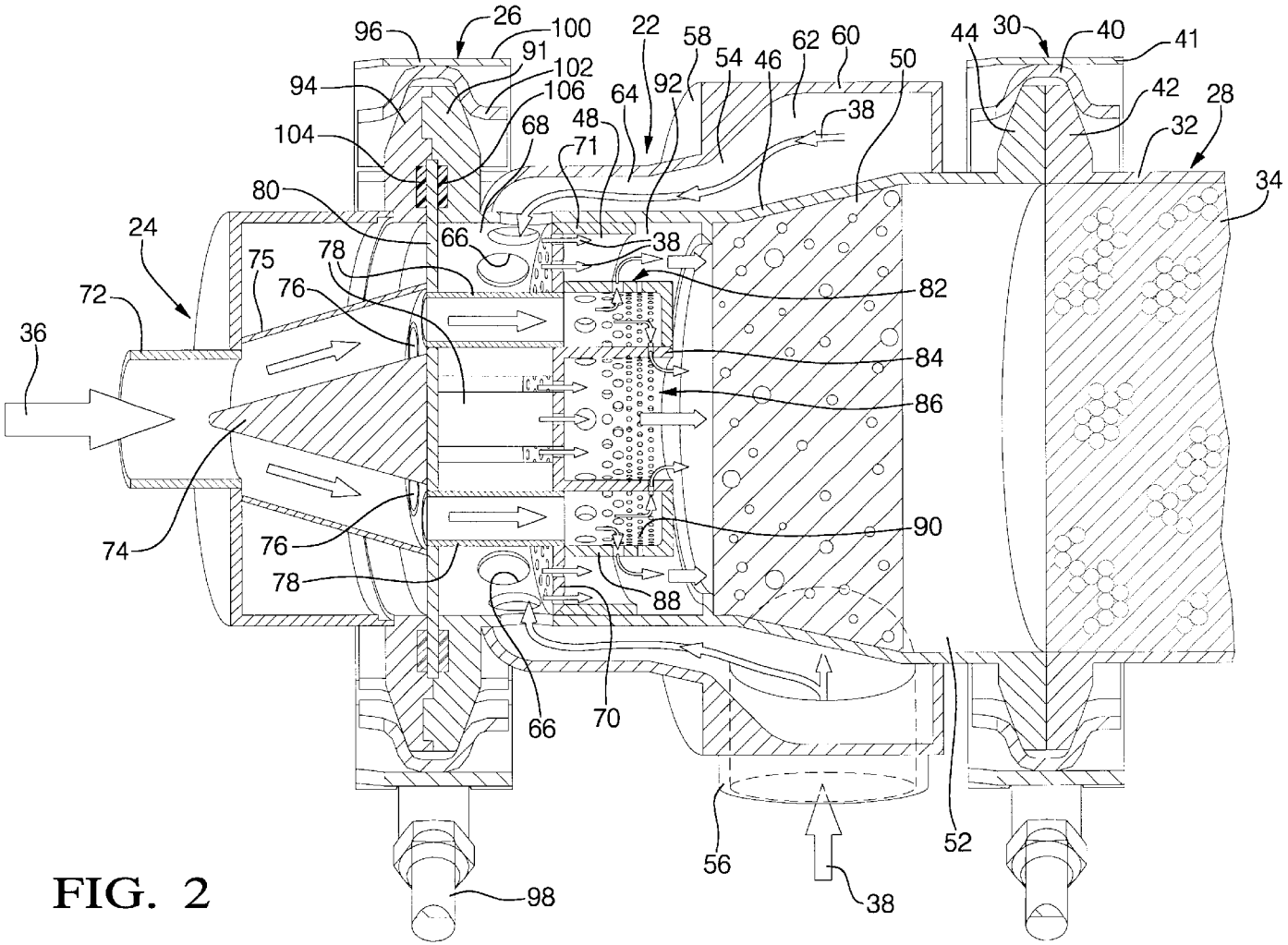
FIG. 2 is a side sectional view of one embodiment of a combuster in accordance with the present invention.
Figure 3:
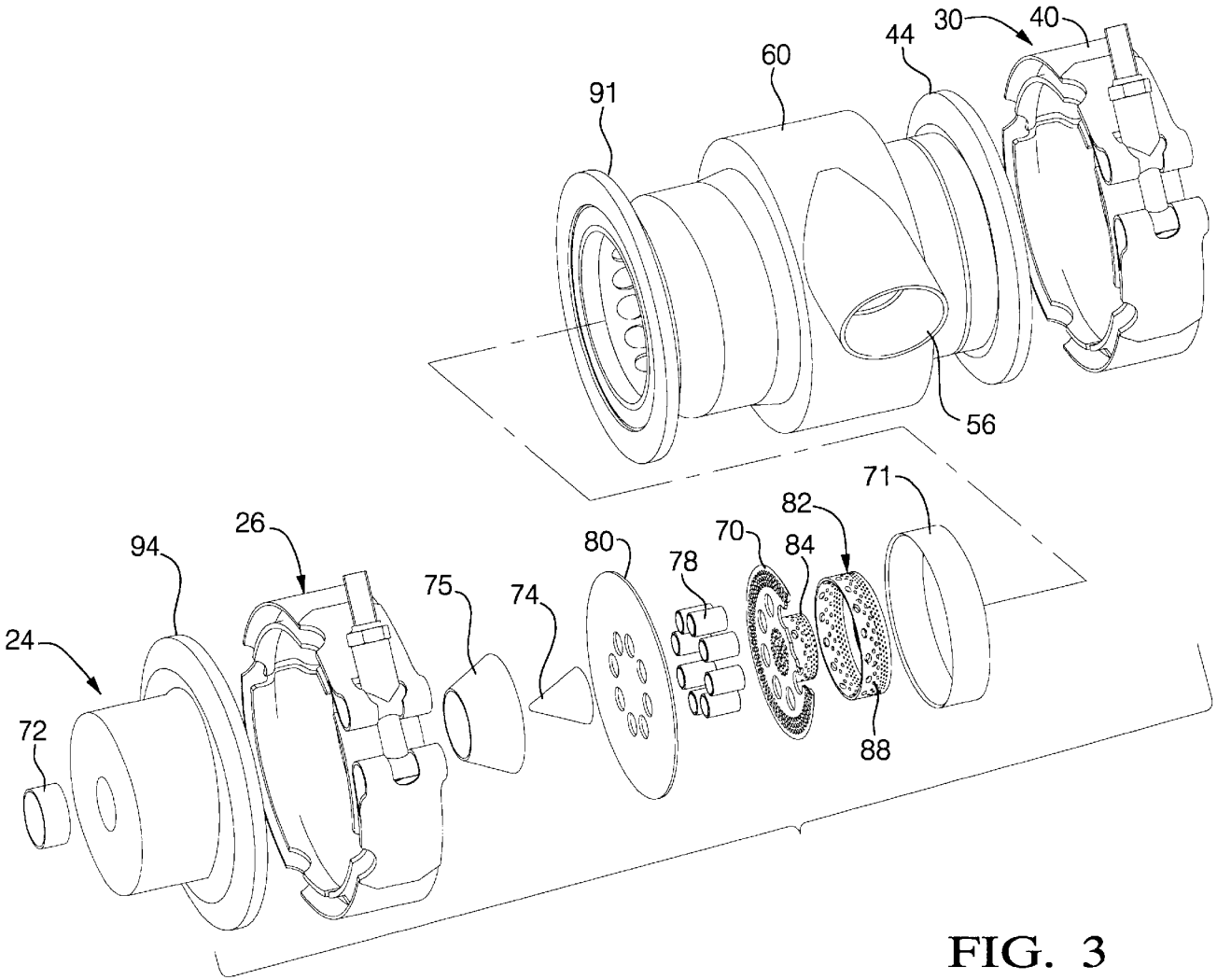
FIG. 3 is an exploded, isometrical view of the mixing section of the combuster of FIG. 2.

FIGS. 2 and 3 depict one embodiment of the present invention and comprises (1) a mixing section 22 having an inlet section 24 (i.e. for one of the gases) joined thereto by means of a quick disconnect connection 26, and (2) a combustion section 28 joined thereto by a quick disconnect connection 30. The combustion section 28 comprises a housing 32 containing a catalyst bed 34 (e.g. pellets, monolith, etc.) suitable for promoting the combustion of fuel cell anode tailgases 36 and cathode tailgases 38. The combustion section 28 is detachably connected to the mixing section 22 by means of the quick disconnect 30 comprising a strap type clamp having a tension band 41 that squeezes a clamping ring 40 about the perimeters of the flanges 42 and 44 that engages and presses the flange 42 on the end of the housing 32 and the flange 44 at the aft end of the mixing section 22 together.

The mixing section 22 comprises a housing 46 defining a mixing chamber 48 where the gases are mixed before they pass through an open cell foam homogenizer/diffuser 50 that serves to (a) further mix the gases, (b) distribute the gas flow substantially evenly over the cross section of the combuster, and (c) prevent propagation of any flame that might exist in the transitional region 52 (i.e. between the foam 50 and catalyst 34) back into the mixing chamber 48. The homogenizing foam 50 will have pore sizes varying from about 10 pores per lineal inch (ppi) to about 80 (preferably about 20–40 ppi). The gases to be mixed are provided to the mixing chamber 48 (a) from two directions generally perpendicular to each other, and (b) into relatively narrow (i.e. compared to FIG. 1) mixing zones within the mixing chamber 48. More specifically the cathode tailgas 38 is supplied to the mixing chamber 48 via a plenum 54 which is tangentially supplied with cathode tailgas 38 via inlet 56. The plenum 54 surrounds both the mixing chamber 48 and the homogenizer 50, and is defined by the annular enclosure 58. The enclosure 58 has a first larger portion 60 that defines a large volume 62 of the plenum 54 that receives the cathode tailgas 38 and delivers it to a narrower, lower volume portion 64 of the plenum 54. In the drawings, the cathode tailgas 38 flows generally from right to left in the plenum 54 which is countercurrent to the flow of anode tailgas 36 through the combuster. This countercurrent flow serves to cool the mixing section 48 while preheating the cathode tailgas 38 for improved combustion. The cathode tailgas 38 exits the plenum 54 via a plurality of holes 66 in the housing 46 which serve to communicate the plenum 54 with the vestibule 68 which, in turn, supplies the cathode tailgases 38 to the mixing section 48.

More specifically, the mixing section 48 is defined at least in part by a gas-permeable upstream distributor 70 which is herein depicted as a perforated plate, but which could just as well be an open cell metal or ceramic plate or the like. The distributor 70 has a skirt 71 that nests within the housing 46, and is adapted to allow the gas in the vestibule 68 to flow into the mixing chamber 48 in an axial direction relative to the length of the combuster. At the same time, the anode tailgas 36 enters the combuster through the inlet section 24. More specifically, the anode tailgas 36 enters inlet pipe 72 flows through the hollow cone 75 and engages the conical deflector or flow splitter 74 which is coaxial with the cone 75 and axially aligned with the pipe 72 along the center line of the combuster, and serves to direct the anode tailgas 36 into the mouths 76 of a plurality of conduits 78 which serve as gas delivery tubes to the mixing chamber 48. The inlet section 24 is separated from the mixing section 22 by a baffle plate 80. The conduits 78 extend from the baffle plate 80 through the vestibule 68 to the perforated plate 70 to conduct the anode tailgas 36 through the vestibule 68 without mixing it with the cathode tailgas 38 therein. Rather, the conduits 78 deliver the anode tailgases to a donut-like distribution ring 82 for dispensing the anode tailgases 36 into the mixing chamber 48 in a direction generally perpendicular to the direction of the flow of the cathode tailgases 38 through the perforated plate 70. More specifically, the distribution ring 82 comprises a first multi-ported annular wall 84 defining a hole 86 in the center of the ring 82 and a second multi-ported annular wall 88 spaced radially outboard from the first wall 84. The inner and outer walls 84 and 88 define an annular cavity 90 therebetween which is adapted to receive the anode tailgases 36 from the delivery conduits 78, and thence to deliver the anode tailgases 36 into the mixing chamber 48 in a radial direction (i.e. inwardly into the hole 86 and outwardly into the annular space 92 surrounding the ring 82) for transverse flow mixing of the gases 36 and 38 in the mixing chamber 48. Flanges 91 and 94 on the upstream end of the mixing section 22 and the downstream end of the inlet section 24 respectively are held together by tension clamp 96 having a tensioning screw 98 for tightening the annular band 100, and thereby pressing the flanges 91 and 94 together by means of the locking ring 102. Gaskets 104 and 106 sealingly engage the plate 80. The combuster may be readily disassembled for modification and/or maintenance by simply releasing the tension clamps about the flanges 42, 44, 91 and 94, and separating the inlet 24, mixing section 22 and combustion section 28 one from the other.

Figure 4:
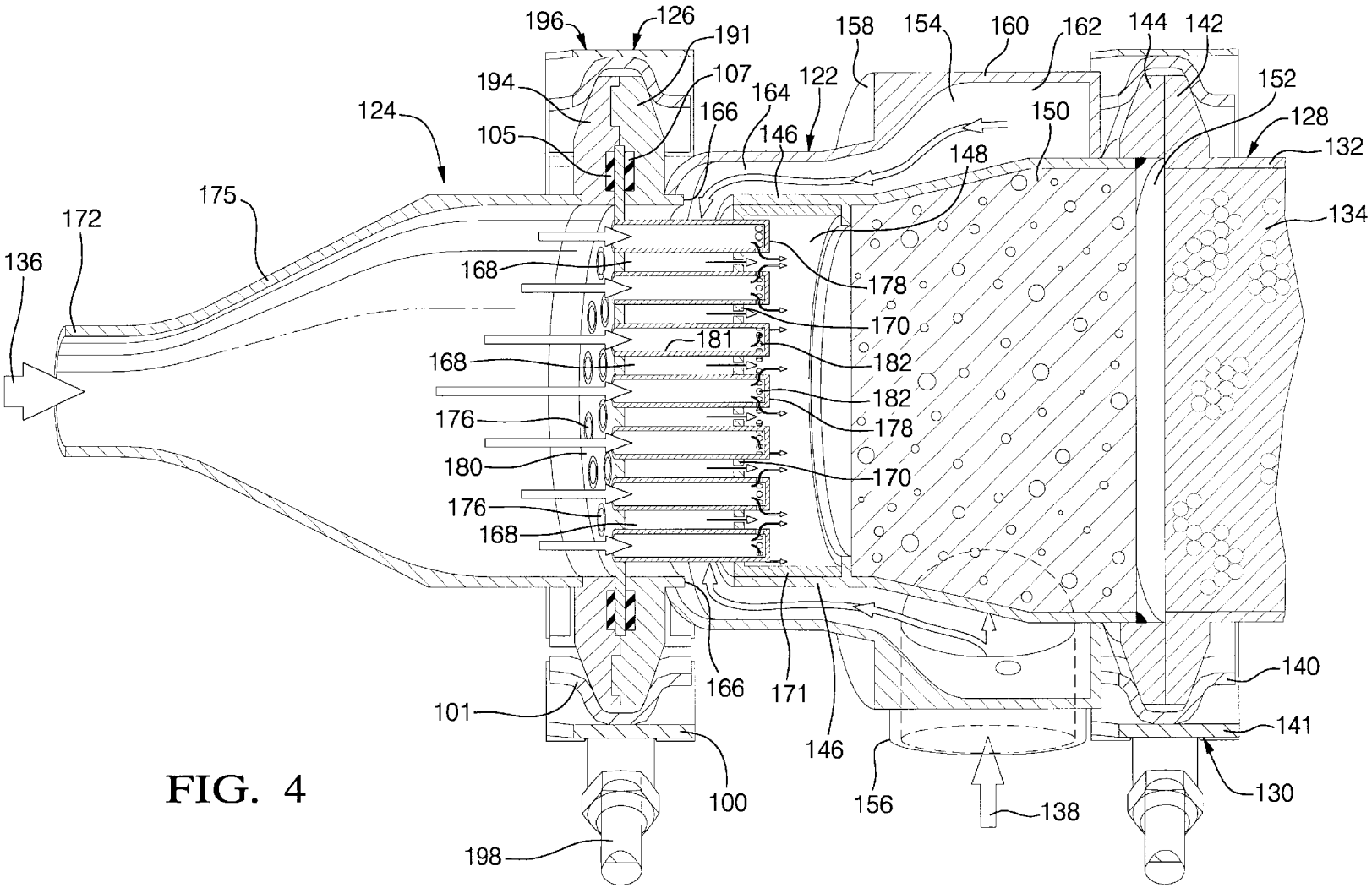
FIG. 4 is a side sectional view of another embodiment of a combuster in accordance with the present invention.
Figure 5:
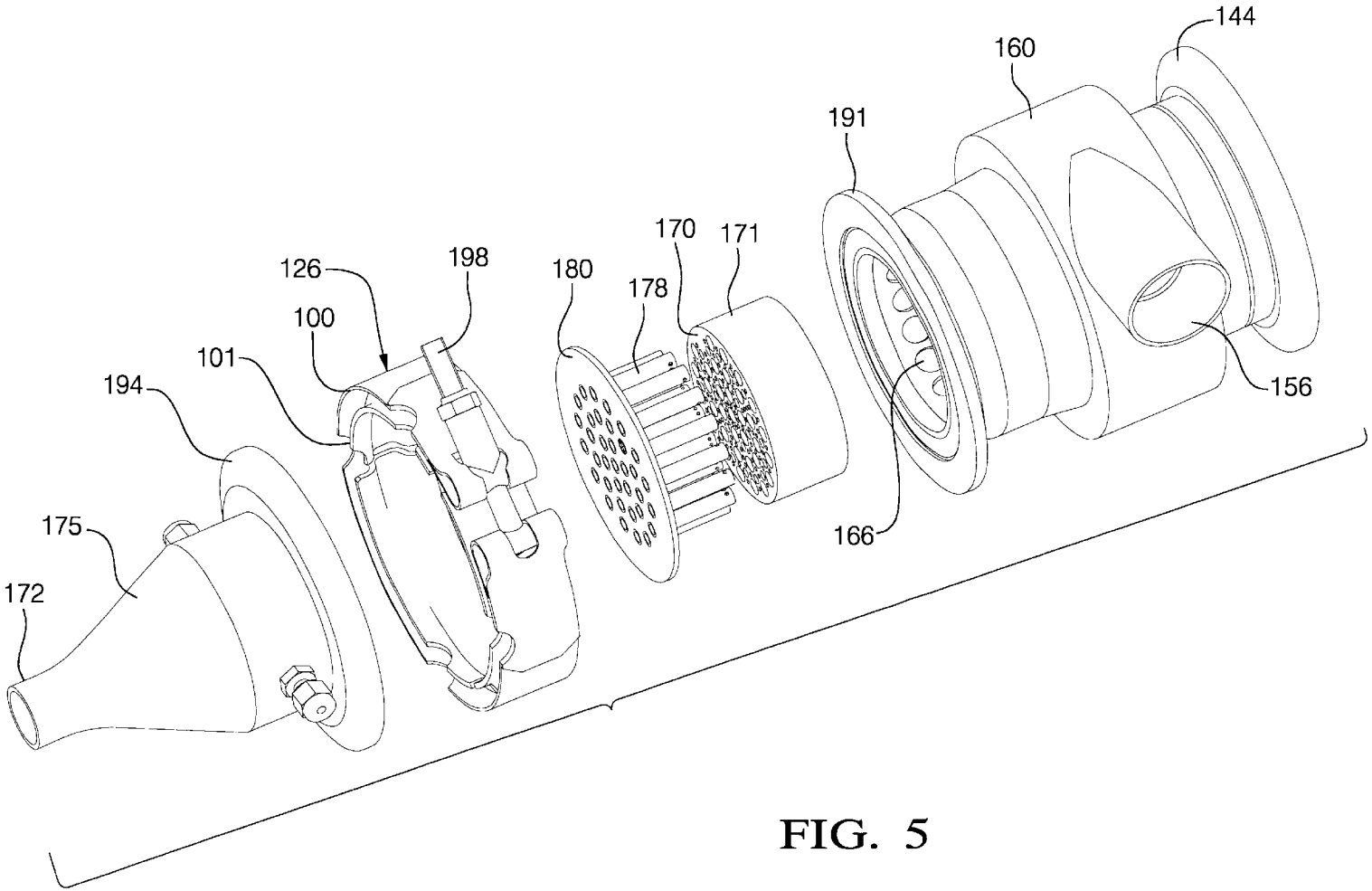
FIG. 5 is an exploded, isometrical view of the mixing section of the combuster of FIG. 4.

FIGS. 4 and 5 depict another embodiment of the invention and comprises (1) a mixing section 122, (2) an inlet section 124 (i.e. for one of the gases) joined thereto by means of a quick disconnect connection 126, and (3) a combustion section 128 joined thereto by a quick disconnect connection 130. The combustion section 128 comprises a housing 132 containing a catalyst bed 134 (e.g. pellets, monolith, etc.) suitable for promoting the combustion of fuel cell anode tailgases 136 and cathode tailgases 138. The combustion section 128 is detachably connected to the mixing section 122 by means of the quick disconnect 130 comprising a strap type clamp having a tension band 141 that squeezes a clamping band 140 about the perimeters of the flanges 142 and 144 and presses them together.

The mixing section 122 comprises a housing having a wall 146 defining a mixing chamber 148 where the gases are mixed before they pass through an open cell foam homogenizer/diffuser 150 that serves to (a) further mix the gases, (b) distribute the gas flow substantially evenly over the cross section of the combuster, and (c) prevent propagation of any flame that might exist in the transitional region 152 (i.e. between the foam 150 and catalyst 134) back into the mixing chamber 148. The homogenizing foam 150 will have pore sizes varying from about 10 pores per lineal inch (ppi) to about 80 (preferably about 20–40 ppi). The gases to be mixed are provided to the mixing chamber 148 (a) from two directions generally perpendicular to each other, and (b) into relatively narrow mixing zones within the mixing chamber 148. More specifically the cathode tailgas 138 is supplied to the mixing chamber 148 via a plenum 154 which is tangentially supplied with cathode tailgas 138 via inlet 156. The plenum 154 surrounds both the mixing chamber 148 and the homogenizer 150, and is defined by the annular enclosure 158. The enclosure 158 has a first larger portion 160 that defines a large volume 162 of the plenum 154 that receives the cathode tailgas 138 and delivers it to a narrower, lower volume portion 164 of the plenum 154. In the drawings, the cathode tailgas 138 flows generally from right to left in the plenum 154 which is countercurrent to the flow of anode tailgas 136 through the combuster. This countercurrent flow serves to cool the mixing section 148 while preheating the cathode tailgas 138 for improved combustion. The cathode tailgas 138 exits the plenum 154 via a plurality of holes 166 in the wal 146 which serve to communicate the plenum 154 with the vestibule 168 which, in turn, supplies the cathode tailgases 138 to the mixing section 148. The mixing section 148 is defined at least in part by a gas-permeable upstream distributor 170 which is herein depicted as a perforated plate, but which could just as well be an open cell metal or ceramic plate or the like. The distributor 170 has a skirt 171 that nests within the wall 146, and is adapted to allow the gas in the vestibule 168 to flow into the mixing chamber 148 in an axial direction relative to the length of the combuster. At the same time, the anode tailgas 136 enters the combuster through the inlet section 124 via inlet 172 and the hollow cone 175, and into the mouths 176 of a plurality of blind tubes 178 which serve as gas distribution and delivery injectors to the mixing chamber 148. The inlet section 124 is separated from the mixing section 122 by a baffle plate 180. The blind gas distribution tubes 178 extend from the baffle plate 180 through the vestibule 168 and the perforated plate 170 to conduct the anode tailgas 136 through the vestibule 168 without mixing it with the cathode tailgas 138 therein. Rather, the distribution tubes 178 dispense the anode tailgases 136 into the mixing chamber 148 via a plurality of ports 182 that extend radially (i.e. realtive to the length pf the tube 178) through the annular sidewalls 181 of the tubes 178, and in a direction generally perpendicular to the direction of the flow of the cathode tailgases 138 through the perforated plate 170.

Flanges 91 and 94 on the upstream end of the mixing section 122 and the downstream end of the inlet section 24 respectively are held together by tension 196 having a tensioning screw 198 for tightening the annular band 100, and thereby pressing the flanges 191 and 194 together by means of the locking ring 101. Gaskets 105 and 107 sealingly engage the plate 180. The combuster may be readily disassembled for modification and/or maintenance by simply releasing the tension clamps about the flanges 142, 144, 191 and 194, and separating the inlet 124, mixing section 122 and combustion section 128 one from the other.

While this invention has been disclosed primarily in terms of the specific embodiment thereof, but is not limited thereto but rather only to the extent set forth hereafter in the claims which follow.

What is claimed is:

1. In a catalytic combuster having a catalyst-filled combustion section for the combustion of hydrogenous fuel and oxygen gases, and a mixing section upstream of said combustion section for mixing said gases preparatory to entering said combustion section, the improvement comprising (a) a housing having a wall defining said mixing chamber, (b) a gas-permeable distributor upstream of said mixing chamber for admitting one of said gases into said mixing chamber in a first direction, (c) a multi-part injector surrounded by said wall for admitting the other of said gases into said mixing chamber in a plurality of directions generally perpendicular to the first direction, (d) an inlet section of said combuster for supplying said other gas to said injector; and (e) a gas-permeable diffuser at the downstream end of said mixing chamber for restricting the outflow of said gases from said mixing chamber and distributing said outflow substantially uniformly over the cross section of said combuster transverse the length of said combuster at the entrance to said combustion section.

2. A combuster according to claim 1 wherein said gas-permeable gas distributor comprises a perforated plate.

3. A combuster according to claim 1 wherein said diffuser comprises an open-cell foam.

4. A combuster according to claim 1 comprising a plurality of openings in said housing upstream of said gas-permeable gas distributor for supplying said first gas behind said distributor.

5. A combuster according to claim 4 comprising an annular plenum surrounding said openings for supplying said one gas to said openings.

6. A combuster according to claim 5 wherein said plenum also surrounds said diffuser.

7. A combuster according to claim 4 including a vestibule between said openings and said distributor for receiving said one gas from said openings.

8. A combuster according to claim 4 wherein at least two of said inlet mixing and combustion sections are attached one to the other by a quick disconnect connection for convenient access to the innards of the combuster.

9. A combuster according to claim 8 including a first flange on the end of said inlet section adjacent said mixing section, and a second flange on the end of said mixing section adjacent said inlet section, said first and second flanges abutting each other to sealingly secure said inlet and mixing sections together.

10. A combuster according to claim 8 including a third flange on the end of said mixing section adjacent said combustion section, and a fourth flange on the end of said combustion section adjacent said mixing section, said third and fourth flanges abutting each other to sealingly secure said mixing and combustion sections together.

11. A combuster according to claim 9 wherein said first and second flanges are clamped together by means of a strap about the perimeter of said flanges.

12. A combuster according to claim 10 wherein said third and fourth flanges are clamped together by means of a strap about the perimeters of said flanges.

13. In a catalytic combuster having a catalyst-filled combustion section for the combustion of hydrogen and oxygen gases, and a mixing section upstream of said combustion section for mixing said gases preparatory to entering said combustion section, the improvement comprising (a) a housing having a wall defining a mixing chamber, (b) a gas-permeable, gas distributor upstream of said mixing chamber for admitting one of said gases into said mixing chamber in a first direction, (c) a distribution ring in said mixing chamber for admitting the other of said gases into said mixing chamber in second and third directions generally perpendicular to the first direction, said distribution ring comprising (i) a first; perforated, annular wall defining a hole in the center of said ring, and (ii) a second perforated annular wall spaced radially outboard said first perforated wall, said first and second walls together defining an annular cavity for receiving said other gas and adapted to inject said other gas in said second and third directions into said mixing chamber radially inwardly through said first permeable wail and radially outwardly through said; second perforated wall, (d) an inlet section of said combuster for supplying said other gas to said distribution ring and (e) a gas-permeable diffuser at the downstream end of said mixing chamber for restricting the outflow of said gases from said mixing chamber and distributing said outflow substantially uniformly over the cross section of said combuster transverse the length of said combuster at the entrance to said combustion section.

14. A combuster according to claim 13 including a vestibule between said openings and said distributor for receiving said one gas from said openings.

15. A combuster according to claim 14 including at least one conduit extending through said vestibule and communicating said inlet with said distribution ring.

16. A combuster according to claim 15 including a plurality of said conduits each having a mouth for receiving said other gas from said inlet.

17. A combuster according to claim 16 including a baffle plate separating said vestibule from said inlet, and wherein said plurality of conduits are arranged in a circle concentric with said hole.

18. A combuster according to claim 17 including a conical deflector concentric with, and radially inboard said circle of mouths for directing said other gas from said inlet into said conduits.

19. In a catalytic combuster having a catalyst-filled combustion section for the combustion of hydrogen and oxygen gases, and a mixing section upstream of said combustion section for mixing said gases prepatory to entering said combustion section, the improvement comprising (a) a housing having a wall defining said mixing chamber, (b) a first gas-permeable gas distributor upstream of said mixing chamber for admitting one of said gases into said mixing chamber in a first direction, (c) a second gas distributor in said mixing chamber for admitting the other of said gases into said mixing chamber in a plurality of directions generally perpendicular to the direction, said second gas distributor comprising a plurality of blind gas distribution tubes extending into said mixing chamber down stream of said first gas distributor, each of said tubes having a sidewall having a plurality of ports therein downstream of said first gas distributor for injecting the other gas into said mixing chamber in said second directions, (d) an inlet section of said combuster for supplying said other gas to said second gas distributor, and (e) a gas-permeable diffuser at the downstream end of said mixing chamber for restricting the outflow of said gases from said mixing chamber and distributing said outflow substantially uniformly over the cross section of said combuster transverse the length of said combuster at the entrance to said combustion section.

20. A combuster according to claim 19 wherein at least two of said inlet, mixing and combustion sections are attached one to the other by a quick disconnect connection for convenient access to the innards of the combuster.

21. A combuster according to claim 20 including a first flange on the end of said inlet section adjacent said mixing section, and a second flange on the end of said mixing section adjacent said inlet section, said first and second flanges abutting each other to sealingly secure said inlet and mixing sections together.

22. A combuster according to claim 20 including a third flange on the end of said mixing section adjacent said combustion section, and a fourth flange on the end of said combustion section adjacent said mixing section, said third and fourth flanges abutting each other to sealingly secure said mixing and combustion sections together.

23. A combuster according to claim 21 wherein said first and second flanges are clamped together by means of a strap about the perimeter of said flanges.

24. A combuster according to claim 22 wherein said third and fourth flanges are clamped together by means of a strap about the perimeters of said flanges.

* * * * *